United States Patent [19]

Helms

[11] 4,456,146

[45] Jun. 26, 1984

[54] COMPOSITE CLOSURE HAVING FRANGIBLE OPENING MEANS

[75] Inventor: Charles R. Helms, Malvern, Pa.

[73] Assignee: Container Corporation of America, Chicago, Ill.

[21] Appl. No.: 515,794

[22] Filed: Jul. 21, 1983

[51] Int. Cl.[3] ..... B65D 17/34

[52] U.S. Cl. ..... 220/270

[58] Field of Search ..... 220/266–273; 229/43

[56] References Cited

U.S. PATENT DOCUMENTS 4,324,342 4/1982 Yamaguchi et al. ..... 220/270

4,360,121 11/1982 Helms ..... 220/270

4,394,919 7/1983 Von Alven et al. ..... 220/270

*Primary Examiner*—George T. Hall

*Attorney, Agent, or Firm*—Richard W. Carpenter

[57] ABSTRACT

A composite closure comprising a central substrate formed of a thin-gauge, metallic metal and two concentric rings being molded to the central substrate. One of the two concentric rings defines an outer ring adapted for securement to the container body. The other of the two concentric rings defines an inner ring serving as tear strip for removing a central portion of the substrate from the container. The substrate is provided with a peripheral line of tear lying between the two concentric rings.

9 Claims, 8 Drawing Figures

COMPOSITE CLOSURE HAVING FRANGIBLE OPENING MEANS

BACKGROUND OF THE INVENTION

1. Field of the Invention

This invention relates generally to closures for containers and more particularly, it relates to composite closures for containers which provides a hermetically sealed arrangement, but is relatively easy to open. Specifically, the present invention is directed to improvements in composite closures consisting of a central substrate formed of a thin-gauge metallic material and having a central portion and an outer portion, and two concentric rings which are injection molded onto the central substrate.

2. Description of the Prior Art

The prior art appears to be best exemplified in the following U.S. Pat. Nos. which were developed in a search directed to the subject matter in this application: 4,044,941, 4,088,242, 4,103,802, 4,210,618, 4,215,791, 4,254,891, 4,268,336.

None of the prior art uncovered in the search disclosed a container closure adapted for securement to an upper, opened end of a container body like that of the present invention which provides a central substrate formed of a thin-gauge metallic material and having a central portion and an outer portion, and two concentric rings which are injection molded onto the substrate. One of the two concentric rings defines an outer ring having attachment means for securement to the container body. The other of the two concentric rings defines an inner ring serving as a tear strip for removing the central portion of the substrate from the container. The substrate is frangible in the area between the two concentric rings to provide a peripheral line of tear.

SUMMARY OF THE INVENTION

Accordingly, it is a general object of the present invention to provide an improved composite closure having a central substrate and two concentric rings which is relatively simple and economical to manufacture and assemble.

It is another object of the present invention to provide a container closure having a central substrate formed of a thin-gauge metallic material in which two concentric rings are injection molded onto the central substrate.

It is another object of the present invention to provide a container closure having a central substrate and two concentric rings in which one of the concentric rings defines an outer ring having attachment means for securement to the container body.

It is still another object of the present invention to provide a container closure having a central substrate and two concentric rings in which one of the concentric rings defines an inner ring serving as a tear strip for removing the central portion of the substrate from the container.

It is yet still another object of the present invention to provide a container closure having a central substrate and two concentric rings in which a peripheral line of tear is formed by the substrate between the two concentric rings.

BRIEF DESCRIPTION OF THE DRAWINGS

These and other objects and advantages of the present invention will become more fully apparent from the following detailed description when read in conjunction with the accompanying drawings with like reference numerals indicating corresponding parts throughout, wherein.

DETAILED DESCRIPTION OF THE PREFERRED EMBODIMENTS

Figure 1:
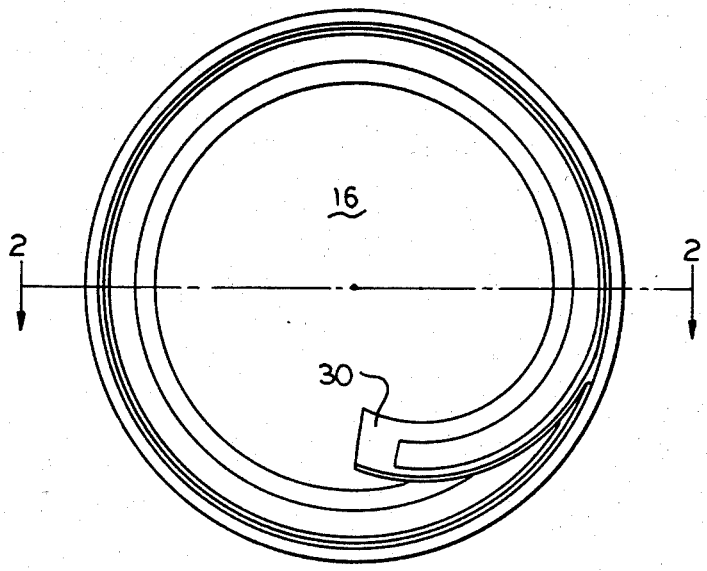
FIG. 1 is a top plan view of a closure embodying the features of the present invention.
Figure 2:
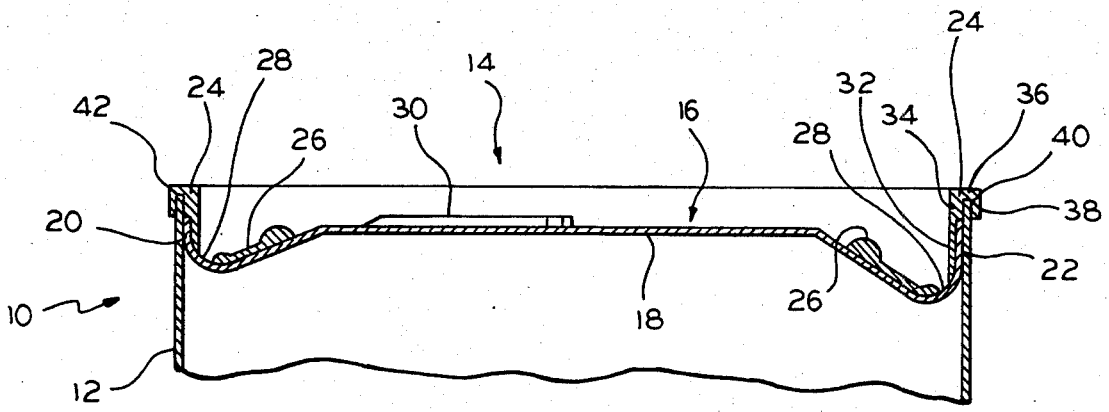
FIG. 2 is a side elevational view of the closure and container of FIG. 1, taken along the lines of 2—2.
Figure 3:
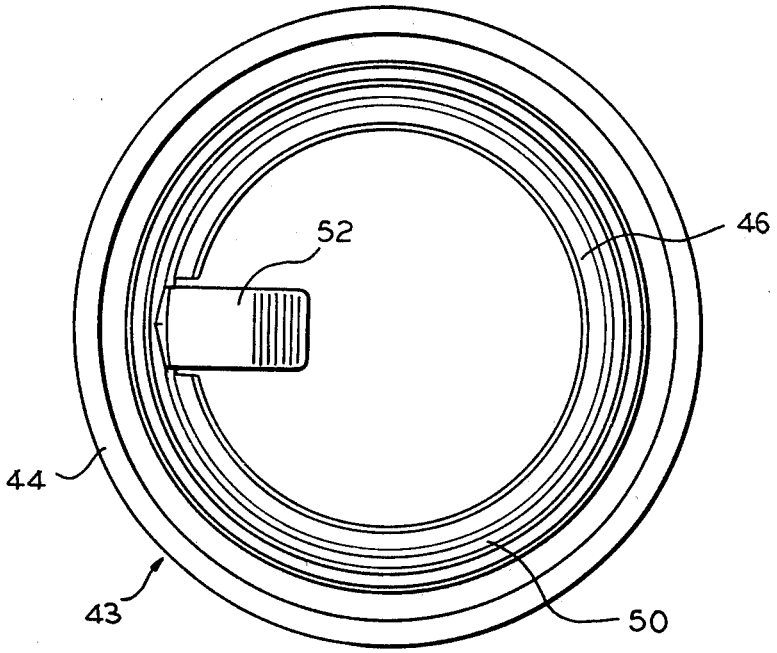
FIG. 3 is a top plan view of a second embodiment of a closure embodying the present invention.
Figure 4:
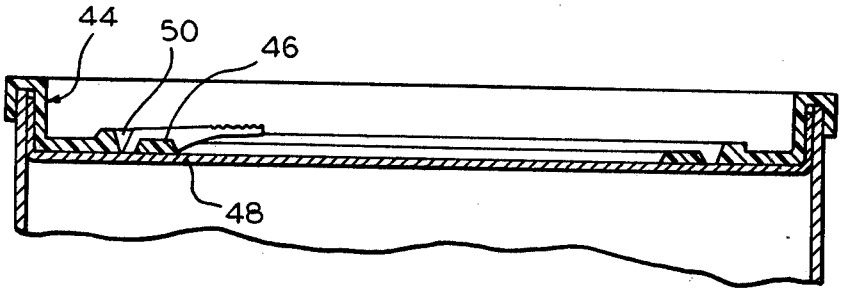
FIG. 4 is a side elevational view of the second embodiment of the closure illustrated in FIG. 3.

Referring now in detail to the various views of the drawings, there are shown in FIGS. 1 and 2 a container designated generally by reference numeral 10 and having a body side wall 12 for receiving an improved composite closure 14 of the present invention. The closure 14 is adapted for securement, such as by heat-sealing, to the container 10. The container body side wall 12 is of a conventional construction and is shown herein for purposes of illustration in a circular configuration. It should be noted that the container body side wall 12 may be rectangular, square, oval, or any other desired shape in its transverse cross-section. The body side wall 12 is preferably made of polyethylene, but may be made of metal such as metal, fiber and the like.

The composite closure 14 comprises a substrate 16 formed preferably of a thin-gauge metal, such as aluminum foil. It should be understood by those skilled in the art that the substrate could be a paper or laminated structure formed of paper and foil. The substrate 16 consists of a central portion 18 extending across the entire opening of the container 10 and terminates in curled end portions 20, 22 respectively. The end portions 20, 22 contact in abutting relationship against the inside surfaces of the container at its upper portion. The closure 14 also includes two concentric rings consisting of an outer rim portion 24 and an inner central portion 26 which are molded onto the substrate 16 by an insert injection molding process. Such a molding process is described and illustrated in U.S. Pat. No. 3,154,612 to Richard F. Schenk et al entitled "Method of Making Composite Container" and issued on Oct. 27, 1965. The outer rim 24 and the central portion 26 are formed of thermoplastic synthetic polymeric metals such as polyethylene or polypropylene and are molded adhere selectively to the substrate within a mold cavity of an injection molding machine. During the molding process, the plastic metal is forced under pressure in the mold cavity to form the outer rim portion and the central portion of the closure 14.

A frangible area 28 lying between the outer rim portion 24 and the inner central portion 26 defines a peripheral line of tear which is void of plastic or where such plastic is of a minimal thickness. The inner portion 26 serves as a tear strip and is provided with an integral pull tab 30 formed to its one end which facilitates gripping and removing of the portion 26 from the container 10. The pull tab 30 overlies the central portion 26, but is free from attachment thereto by reason of a releasable coating 31 such as varnish underneath the pull tab.

After the closure 14 has been constructed as described hereinabove, it may be placed onto the upper, opened end of the container 10 filled with a retail product. The closure 14 will be in tight friction engagement with the top end of the container. Further, the closure 14 and the container 10 are adapted to be hermetically sealed by induction sealing or in any other manner well known in the art. When it is desired to open the container for use, the ultimate consumer merely grasps the tab portion 30 and pulls upwardly on it away from the container. As a result, the inner portion or tear strip 26 and the central portion 18 of the substrate 16 will become separated from the container breaking the substrate at the line of tear 28.

The outer rim portion 24 includes a first section 32 molded to the upper surface of the terminal portions 20, 22 and a second section 34 abutting the inside surface of the container 10. The outer rim portion 24 further consists of a top section 36 and a flange section 38. Between the second section 34 and the flange section 38, there is formed a downwardly extending groove 40 for encompassing the top free edge 42 of the container 10. As can be seen, this provides a good seal between the outer rim portion 24 and the upper end of the container due to their similar metals. If the substrate of the composite closure is made of foil, there will be eliminated the need of providing foil in the container body side wall 12.

Figure 5:
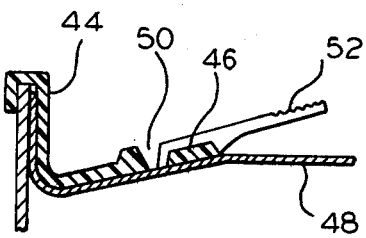
FIG. 5 is a partial, sectional view for the second embodiment, illustrating the tension created on the foil substrate as the pull tab is lifted up initially.
Figure 6:
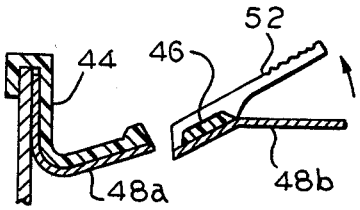
FIG. 6 is a partial, sectional view of the second embodiment, illustrating the foil substrate being separated into two portions.

A second embodiment of a composite closure of the present invention is shown in FIGS. 3–6. As can best be seen in FIGS. 3 and 4, a composite closure 43 comprises two concentric rings which include an outer plastic ring 44 and an inner plastic ring 46 both molded to a foil substrate 48. It should be noted that no plastic is injected into the area 50 between the inner ring 46 and the outer ring 44. FIG. 5 shows the tension created on the foil substrate 48 as the pull tab 52 is lifted up initially for removing the inner ring 46 along the line of tear 50. FIG. 6 shows the foil substrate separated into portions **48*a* and 48*b*. The outer ring 44 remains on the container while the inner ring 46** is removed therefrom.

Figure 7:
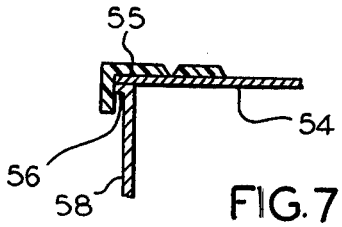
FIG. 7 illustrates an alternative rim configuration for the closure of the present invention in which the rim has an outwardly extending flange.
Figure 8:
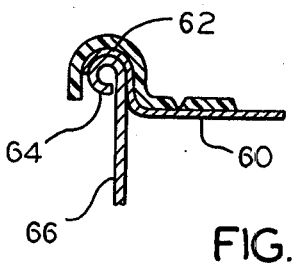
FIG. 8 is another alternative rim arrangement for the container of the present invention in which the rim has an outwardly rolled edge portion.

Referring now to FIGS. 7 and 8, there is shown an alternative embodiment of the foil and container arrangement of the present invention. In FIG. 7, the foil 54 is flat in its entire cross section and has an end portion 55 for engagement with a radially outwardly extending flange portion 56 of the container 58. In FIG. 8, the foil 60 has a rounded, end portion 62 for accommodating an outwardly rolled edge portion 64 of the container 66.

From the foregoing detailed description, it can thus be seen that the present invention provides an improved composite closure consisting of a central substrate formed of a thin-gauge metallic metal and two concentric rings which are injection molded onto the central substrate. Further, one of the concentric rings defines an inner ring serving as a tear strip for removing the central portion of the substrate from the container.

While there has been described and illustrated what are at present to be preferred embodiments of the present invention, it will be understood by those skilled in the art that various changes and modifications may be made, and equivalents may be substituted by elements thereof without departing from the true scope of the invention. In addition, many modifications may be made to adapt a particular situation or metal to the teachings of the invention without departing from the central scope thereof. Therefore, it is intended that this invention not be limited to the particular embodiments disclosed as the best modes contemplated for carrying out this invention, but that the invention will include all embodiments falling within the scope of the appended claims.

What is claimed is:

1. A container closure adapted for securement to an upper, opened end of a container body, said closure comprising:

a central substrate having a central portion and an outer portion;

two concentric rings formed of plastic and being molded onto said central substrate;

one of said two concentric rings defining an outer ring having attachment means for securement to the container body;

the other of said two concentric rings defining an inner ring serving as a tear strip for removing the central portion of said substrate from the container;

said substrate having a peripheral line of tear lying between said two concentric rings.

2. A container closure as claimed in claim 1, wherein said tear strip is provided with an integral tab free from attachment to said substrate.

3. A container closure as claimed in claim 1, wherein said substrate comprises a thin-gauge metallic foil.

4. A container closure as claimed in claim 1, wherein said substrate comprises a paper-foil laminated structure.

5. A container closure as claimed in claim 1, wherein the upper, opened end of the container body has a radially outwardly extending flange portion.

6. A container closure as claimed in claim 1, wherein the upper, opened end of the container body has an outwardly rolled edge portion.

7. A container closure as claimed in claim 1, wherein an area between said two concentric rings is void of plastic.

8. A container closure as claimed in claim 1, wherein an area between said two concentric rings has a thin layer of plastic.

9. A container closure as claimed in claim 1, wherein said substrate comprises a paper laminated structure.

* * * * *